US010583967B2

(12) United States Patent
Watkins et al.

(10) Patent No.: US 10,583,967 B2
(45) Date of Patent: Mar. 10, 2020

(54) OUTSERT FOR SWING CAP ASSEMBLY

(71) Applicant: ALECO CONTAINER, LLC, Arvada, CO (US)

(72) Inventors: Evan D. Watkins, Evergreen, CO (US); Michael Atkinson, Westminster, CO (US); Scott Coors, Arvada, CO (US)

(73) Assignee: SCI LLLP, Denver, CO (US)

( * ) Notice: Subject to any disclaimer, the term of this patent is extended or adjusted under 35 U.S.C. 154(b) by 374 days.

(21) Appl. No.: 15/478,062

(22) Filed: Apr. 3, 2017

(65) Prior Publication Data

US 2017/0283131 A1 Oct. 5, 2017

Related U.S. Application Data

(60) Provisional application No. 62/317,762, filed on Apr. 4, 2016.

(51) Int. Cl.

| | |
|---|---|
| ***B65D 45/06*** | (2006.01) |
| ***B65D 39/00*** | (2006.01) |
| ***B65D 1/02*** | (2006.01) |
| ***B65D 35/42*** | (2006.01) |
| ***B65D 43/02*** | (2006.01) |
| ***B65D 1/46*** | (2006.01) |

(52) U.S. Cl.

CPC ..... *B65D 45/06* (2013.01); *B65D 1/023* (2013.01); *B65D 1/0207* (2013.01); *B65D 1/46* (2013.01); *B65D 35/42* (2013.01); *B65D 39/0082* (2013.01); *B65D 43/022* (2013.01)

(58) Field of Classification Search

CPC ..... B65D 45/00; B65D 45/02; B65D 45/04; B65D 45/06; B65D 39/0082; B65D 1/46; B65D 35/42; B65D 43/022

USPC ..... 215/239, 240, 241, 40, 42, 43, 46; 220/322, 315, 319

See application file for complete search history.

(56) References Cited

U.S. PATENT DOCUMENTS

| | | | | | |
|---|---|---|---|---|---|
| RE7,797 | E | * | 7/1877 | Rich | 215/241 |
| 588,009 | A | * | 8/1897 | De Quillfeldt | B65D 39/0082 215/241 |
| 588,285 | A | * | 8/1897 | Meyer | B65D 39/0082 215/241 |
| 636,801 | A | * | 11/1899 | Hovermann | B65D 39/0082 215/241 |
| 1,369,477 | A | * | 2/1921 | Simenowsky | B65D 45/06 215/239 |
| 1,468,314 | A | * | 9/1923 | Der Lee | B65D 45/06 215/241 |

(Continued)

OTHER PUBLICATIONS

Watkins, Evan D.; Atkinson, Michael; Coors, Scott, U.S. Appl. No. 15/478,035, filed Apr. 3, 2017 for "Outsert for Aluminum Wine Bottle," 17 pages.

*Primary Examiner* — Andrew T Kirsch
*Assistant Examiner* — Jennifer Castriotta
(74) *Attorney, Agent, or Firm* — William O'Meara; Cochran Freund & Young LLC

(57) ABSTRACT

An aluminum bottle outsert including a generally truncated cone-shaped inner surface configured to be received and supported by an upper neck portion of an aluminum bottle and an outer surface having diametrically opposed first and second indents adapted to operably receive prong end portions of a swing cap assembly.

14 Claims, 4 Drawing Sheets

(56) References Cited

U.S. PATENT DOCUMENTS

| | | | | |
|---|---|---|---|---|
| 1,806,364 | A * | 5/1931 | Newman | B65D 35/42 220/322 |
| 2,092,964 | A * | 9/1937 | Birger | B65D 35/42 222/512 |
| 9,139,324 | B1 | 9/2015 | Watkins | |
| 2017/0015462 | A1* | 1/2017 | Roth | B65D 45/06 |

* cited by examiner

OUTSERT FOR SWING CAP ASSEMBLY

This application claims the benefit of U.S. provisional patent application Ser. No. 62/317,762 of Evan Watkins, Scott Coors and Michael Atkinson entitled OUTSERT FOR SWING CAP ASSEMBLY, filed on Apr. 4, 2016, which is hereby incorporated by reference for all that it discloses.

RELATED APPLICATION

The present application is related to U.S. provisional patent application Ser. No. 62/317,771 of Evan Watkins, Scott Coors and Michael Atkinson entitled OUTSERT FOR ALUMINUM WINE BOTTLE, filed on Apr. 4, 2016. The present application is also related to U.S. patent application Ser. No. 15/478,035 of Evan Watkins, Scott Coors and Michael Atkinson, entitled OUTSERT FOR ALUMINUM WINE BOTTLE, filed on the same date as the present application, and which is a non-provisional application claiming the benefit of said U.S. provisional patent application Ser. No. 62/317,771. Both US patent applications referenced in this paragraph are hereby incorporated by reference for all that is disclosed therein.

BACKGROUND

Glass bottles with swing cap closure assemblies, such as made popular by Grolsch Brewery of the Netherlands, have been in use for decades. Such a swing cap assembly has a pivot structure formed by two wire members. The cap member has an associated gasket that is adapted to seal the bottle opening. The glass bottle may be placed in an open state or a closed state by operation of the pivot structure.

SUMMARY

An aluminum bottle outsert has a generally truncated cone-shaped inner surface configured to be received and supported by an upper neck portion of an aluminum bottle. The outsert has an outer surface with diametrically opposed first and second indents adapted to operably receive prong end portions of a swing cap assembly.

A beverage bottle assembly includes an aluminum bottle having a neck with an outsert mounting region. The outsert mounting region includes a constant diameter neck portion; a rolled larger diameter neck portion integrally formed with the constant diameter neck portion at an upper end of the constant diameter neck portion; and an outwardly flared neck portion positioned below the constant diameter neck portion. The beverage bottle assembly also includes a bottle outsert. The outsert is mounted below the rolled larger diameter neck portion and engages at least the rolled larger diameter neck portion and the outwardly flared neck portion. The outsert has an outer surface with diametrically opposed first and second indents therein that are adapted to pivotally receive prong end portions of a swing cap assembly.

A method of making a beverage container with a swing top closure includes fixedly mounting an outsert on a neck portion of a metal bottle. The method also includes mounting a swing cap assembly on the outsert.

DETAILED DESCRIPTION

Figure 1:
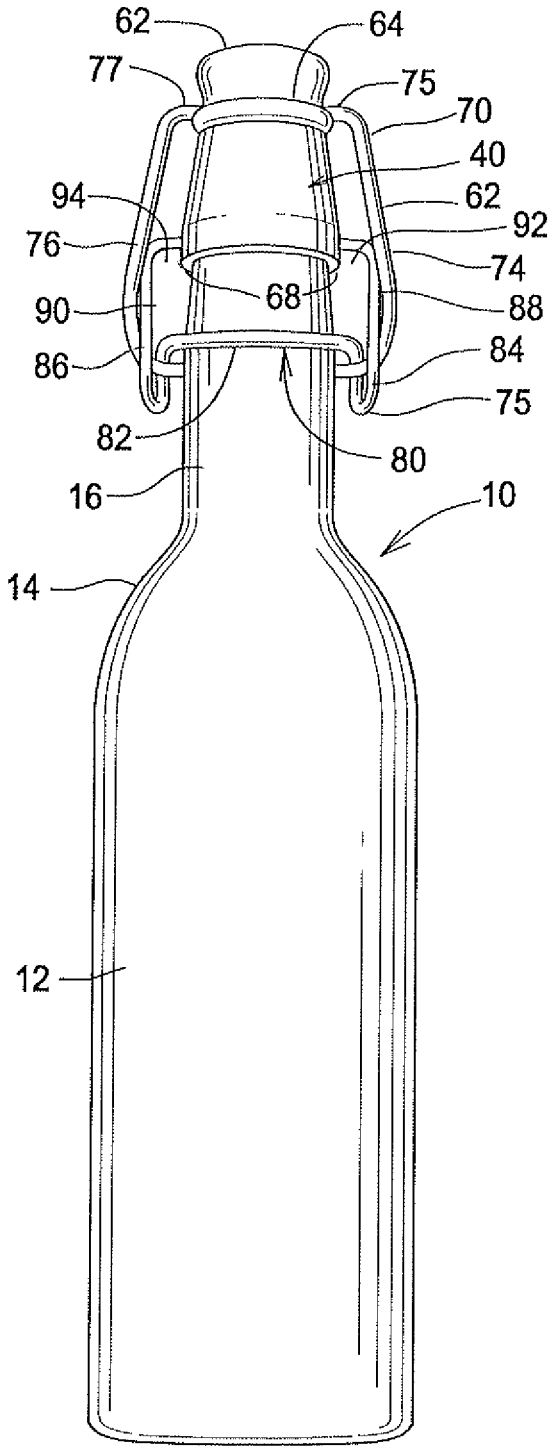
FIG. 1 Is a side elevation view of an aluminum bottle with an outsert and a swing cap assembly in a closed operating position.

FIG. 1 Is a side elevation view of an aluminum bottle 10 with an outsert 40 mounted thereon. The outsert 40 may be constructed from a high strength plastic, such as polyethylene terephthalate ("PTB"), or other relatively high strength material such as ceramics. The outsert 40 has a swing cap assembly 60 pivotally attached to it. The aluminum bottle 10 has a constant diameter barrel portion 12, a varying diameter shoulder portion 14 and a varying diameter neck portion 16. The neck portion 16 has an outset mounting region at its upper end as further described below.

Figure 2:
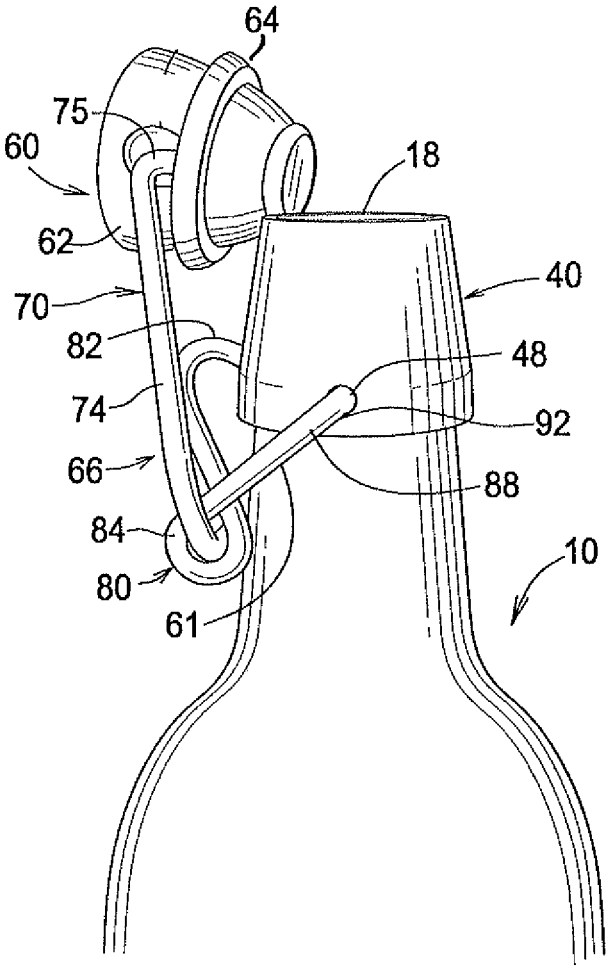
FIG. 2 is an isometric view of the aluminum bottle and outsert of FIG. 1 with the swing cap assembly in a first open operating position.
Figure 3:
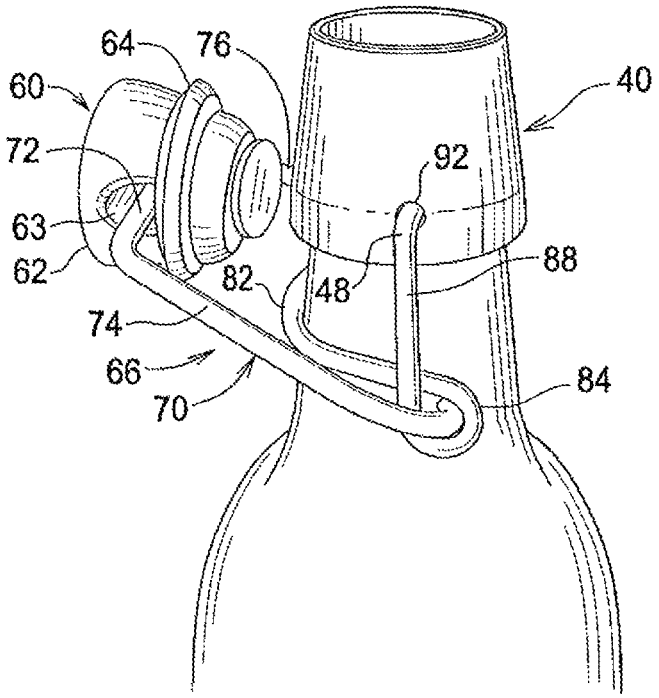
FIG. 3 is an isometric view of the bottle outsert and the swing cap assembly of FIGS. 1 and 2 with the swing cap assembly in a second open operating position.

FIG. 2 is an isometric view of the aluminum bottle 10 and swing cap assembly 60 of FIG. 1, with the swing cap assembly 60 in a first open operating position. FIG. 3 is an isometric view of the aluminum bottle 10 and swing cap assembly 60 of FIG. 2 with the swing cap assembly 60 in a second open operating position. As shown by FIGS. 1, 2 and 3, the swing cap assembly 60 includes a cap member 62, which may be constructed from plastic, glass, ceramic or other material. In one example embodiment, the cap member is constructed from polypropylene homopolymer. The cap member 62 has a hole 63 extending laterally therethrough adapted to receive a corresponding portion of the swing cap assembly 60.

The swing cap assembly 60 also includes a pivot assembly 66, which may be formed from first and second wire members 70, 80. The first wire member 70 has a central body portion 72 that extends through a hole 63 in the cap member 62. The first wire member 70 also includes arm portions 74, 76 that terminate in inwardly projecting prong portions 75, 77.

The second wire member 80 has a central arcuate portion 82 that is integrally connected at either end to loop portions 84, 86. The loop portions 84, 86 are in turn connected to arm portions 88, 90 that terminate in inwardly projecting prong portions 92, 94. The prong portions 92, 94 extend into indents 48 on opposite sides of the outsert 40. The indents 48 may extend partially through or entirely through the wall of the outsert 40.

A flexible sealing member/gasket 64 is mounted on a bottom portion of the cap 62 and is adapted to make sealing contact with the curled end portion of the bottle 10 and the top edge 42 of the outsert 40. The flexible sealing member 64 in one example embodiment is constructed from thermoplastic vulcanizate. The swing cap assembly 60 is hand displaceable from the closed operating position shown in FIG. 1 to the first or initial open operating position shown in FIG. 2, and then to the second or fully open operating position shown in FIG. 3. The swing cap assembly may be closed by swinging the cap member 62 back above the bottle opening and pushing down on the arcuate portion 82 of the second wire member 80.

Figure 4:
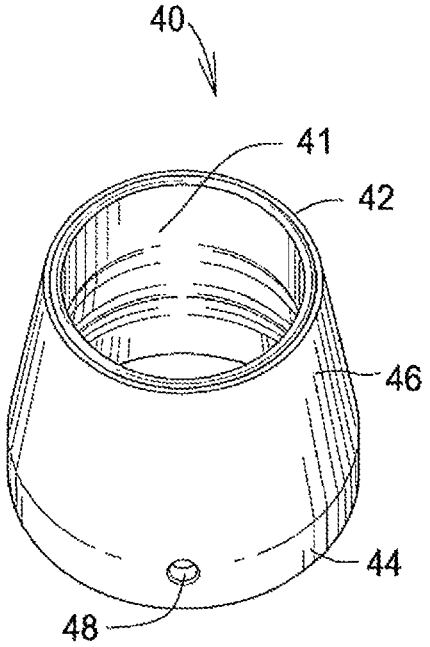
FIG. 4 is an isometric top view of the bottle outsert shown in FIG. 1-3.
Figure 5:
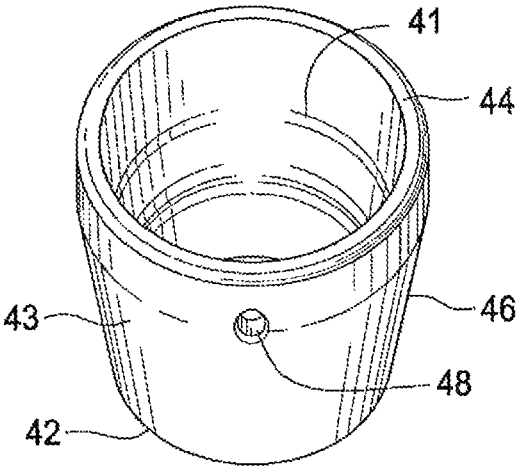
FIG. 5 is an isometric bottom view of the bottle outsert of FIGS. 1-4.
Figure 6:
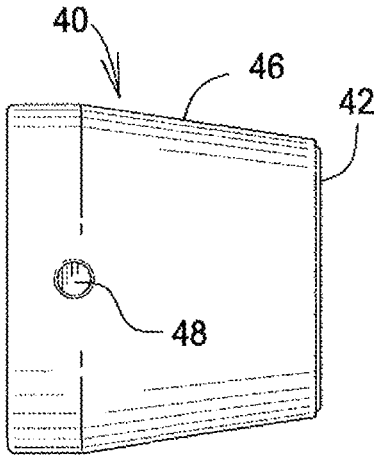
FIG. 6 is a side elevation view of the bottle outsert of FIGS. 1-5.

FIG. 4 is an isometric top view of the bottle outsert 40 shown in FIG. 1-3; FIG. 5 is an isometric bottom view thereof; and FIG. 6 is a side elevation view thereof. As best shown in FIGS. 4-6, the bottle outsert 40 is a tubular member having a generally truncated cone-shape. The outsert 40 has a sidewall 46 with an inner surface 41 and an outer surface 43 connected by an annular top edge surface 42 and an annular bottom edge surface 44.

Figure 7:
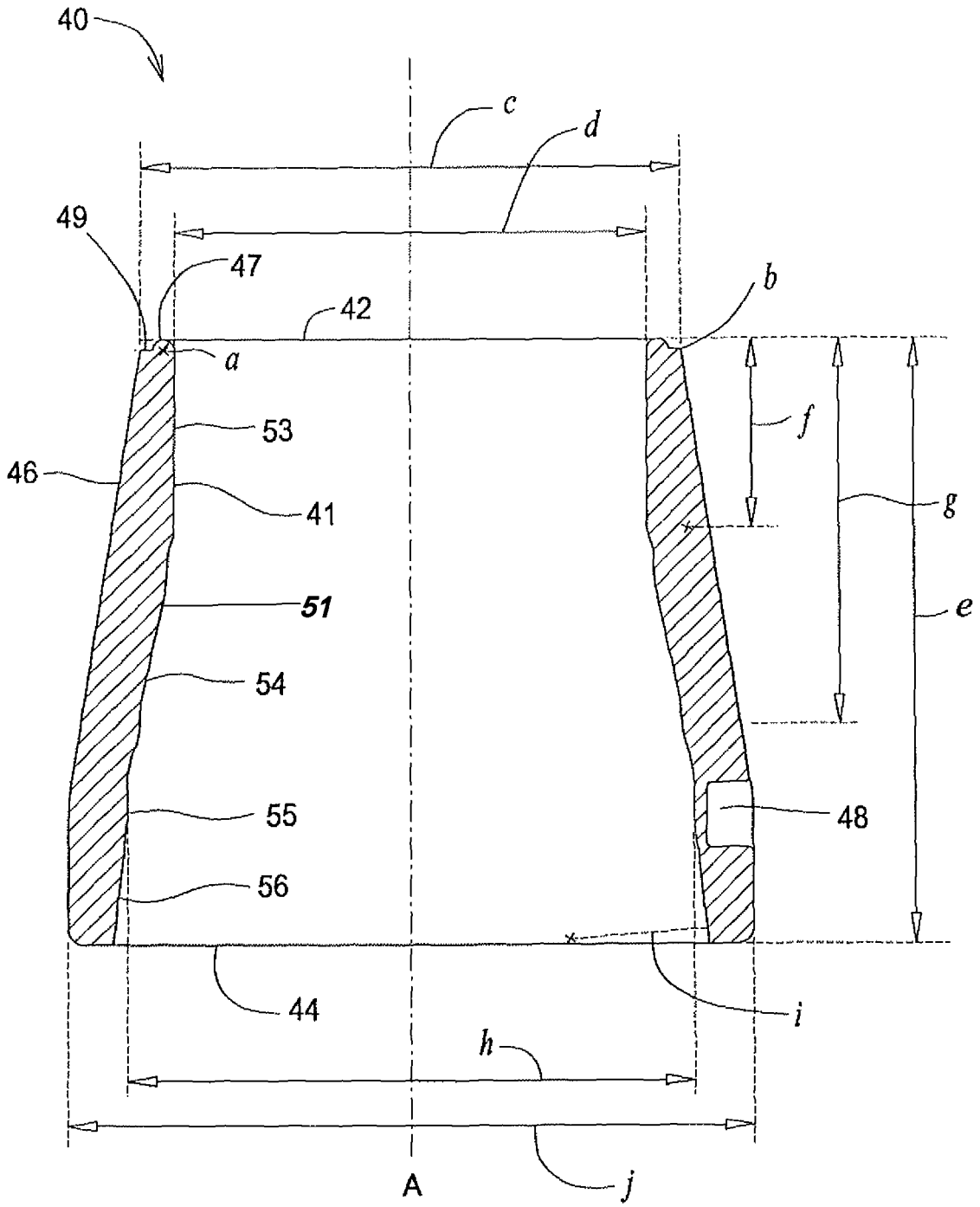
FIG. 7 is a detail cross sectional view of the bottle outsert of FIG. 1-6.

FIG. 7 is a detail cross-sectional elevation view of the bottle outsert of FIGS. 1-6. The top edge surface 42 on the outsert 40 includes an annular inner rounded nose portion 47 and an annular outer ledge portion 49. The top edge surface 42 is adapted to have a top annular portion of the aluminum bottle plasticly deformed over it, forming a top curl portion of the bottle 10 as further described below. In this example embodiment the rounded nose portion 47 has a radius "a" of 0.020 in, the ledge portion 49 has a radius "b" of 0.005 in. The outer diameter "c" of the top edge surface 42 is 0.987 in and the inner diameter "d" is 0.868 in. The overall axial length of the outsert 40 "e" is 1.101 in.

The outsert inner wall 51 has an upper axial portion 53 with a vertical inner wall parallel to the central axis AA of the outsert 40. In this embodiment the outsert axial portion 53 has an a axial length "f" of 0.350 in. The outsert inner wall 51 has an outwardly flairing second axial portion 54 extending form the upper axial portion for an axial distance "g" of about 0.696 in. Another substantially vertical inner wall portion 55 extends axially downwardly from second wall portion 54 and may have a maximum diameter "h" of 1.024 in. Inner wall portion 55 is located at the same axial position as indents 48.

Another curved, outwardly flared inner wall portion 56 extends from wall portion 55 and has a radius of curvature "i" of 0.250 in. The annular bottom edge surface 44 has an outer diameter "j" of 1.235 in. Dimensions for one example outsert are provided in this paragraph. Outserts having other dimensions may also be used depending upon the geometry of the associated bottle 10. The inner surface of the outsert engages and co-acts with the outer surface of the bottle neck portion to maintain the outsert at a fixed axial position relative the bottle neck portion.

Figure 8:
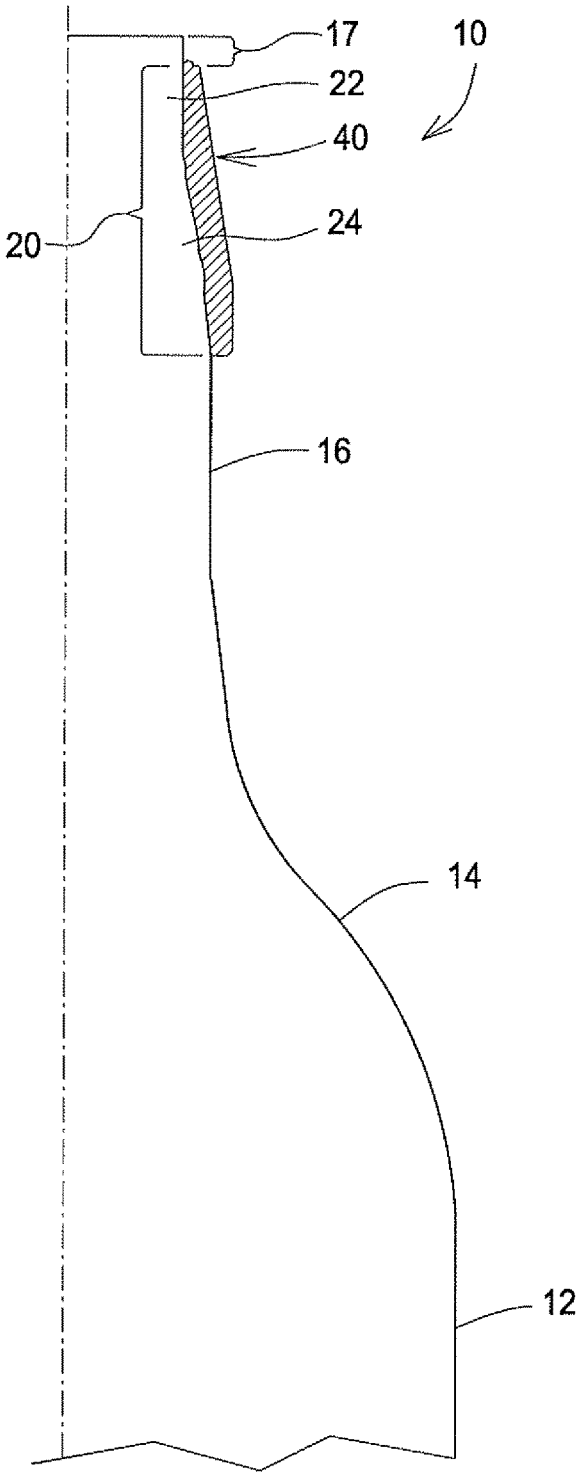
FIG. 8 is a cross-sectional view of an aluminum bottle with an outsert positioned thereon prior to end-roll ("curl") formation.

FIG. 8 is a detailed cross-sectional view of an upper portion of bottle 10, according to one example embodiment. The bottle 10 comprises a barrel portion 12, a varying diameter shoulder portion 14, and a varying diameter neck portion 16. An upper part of the neck portion 16 includes an outsert mounting region 20 and an upper axial end portion 17 that is positioned immediately above the outsert mounting region 20. In one embodiment, the neck upper axial end portion 17, which extends above the outsert 40 when the outsert 40 is initially mounted on the bottle, has an axial length of about 0.115 in.

The outsert mounting region 20 comprises a geometric configuration conforming generally to the inner wall surface 53 51 of the outsert 40, as described for one specific embodiment with reference to FIG. 7. For example, the outsert mounting region 20 may have an overall axial length of about 1.1 in. The mounting region 20 may comprise a generally vertical annular wall region 22 having a diameter of about 0.9 in. The mounting region 20 may also have an outwardly flairing region 24 having diameters slightly larger than the diameters of corresponding inner surfaces 54, 55, and 56 of the outsert 40.

Figure 9:
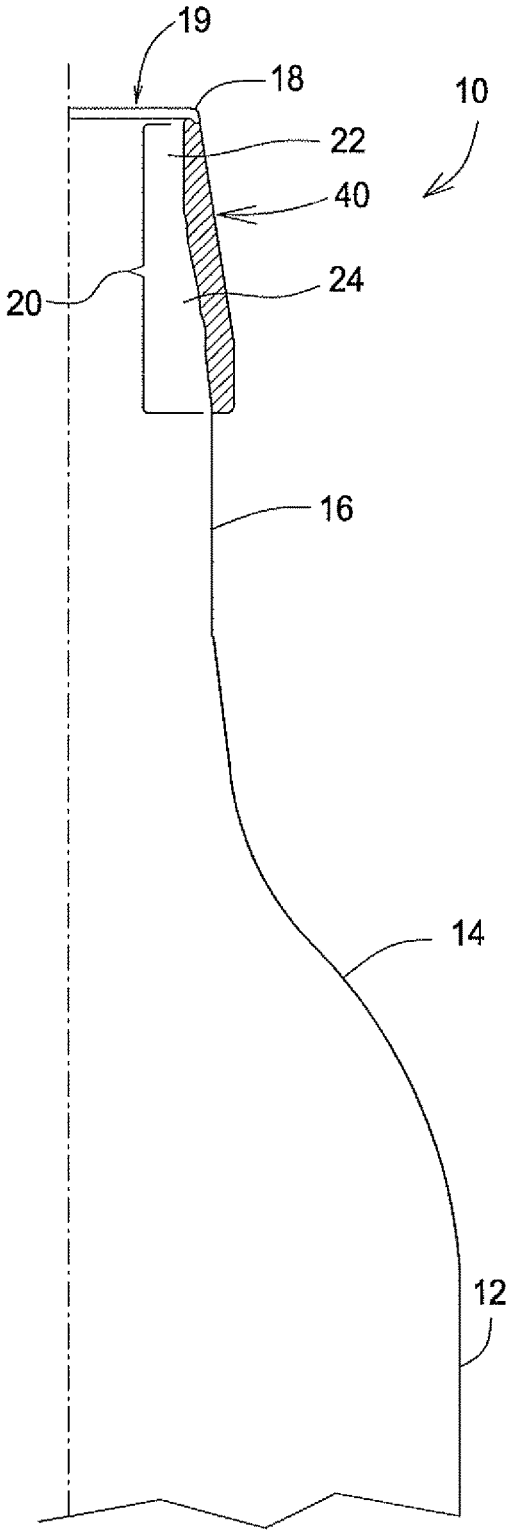
FIG. 9 is a cross-sectional view of the aluminum bottle and outsert shown in FIG. 8 after end-roll formation.

FIG. 9 is a cross-sectional view of the aluminum bottle 10 with an outsert 40 fixedly mounted thereon. The outsert 40 is attached to the bottle neck portion 16 in the mounting region 20 thereof. The bottle axially extending top end portion 17, which is positioned directly above the mounting region 20 in FIG. 8, has, in FIG. 9, been rolled over the top edge portion 42 of the outsert 40 to form a curl portion 18. More specifically, the curl portion 18 curls over the rounded nose portion 47 and terminates at the ledge portion 49. The curl portion 18 and edge portion 49 form a smooth seam at the top edge of the outsert that defines the bottle opening 19. The curl portion 18 may be formed, for example, as described in U.S. Pat. No. 9,139,324 of Watkins et al. for METAL BOTTLE TYPE CONTAINER WITH INSERT/OUTSERT AND RELATED METHODOLOGY, issued Sep. 22, 2015, which is hereby incorporated by reference for all that it discloses.

The curl portion 18 prevents the outsert 40 from moving upwardly and forms the surface against which the swing cap assembly 60 acts to seal the bottle opening 19. The inner surface 41 of the outsert 40 engages the outer surface of the bottle's outsert mounting region 20, described above with reference to FIG. 8. The engagement of the outsert inner surface 41 with the bottle exterior surface in the outsert mounting region 20, prevents the outsert 40 from moving downwardly on the bottle neck 16 beyond the position shown in FIG. 9. Thus, the outsert is effectively captured between the bottle curled portion 18 and the outer surface of the bottle 10 in the outsert mounting region 20.

Embodiments of an aluminum bottle assembly, including an outsert and a swing top capping assembly, and various components thereof and related methodologies are described in detail herein. Alternative embodiments of the aluminum bottle assembly and its components and related methodologies will occur to those skilled in the art after reading this disclosure. It is intended that the language of the appended claims be construed broadly to cover all such alternative embodiments, except to the extent limited by the prior art.

What is claimed is:

1. An aluminum bottle outsert comprising:

a generally truncated cone-shaped inner surface configured to be received and supported by an upper neck portion of an aluminum bottle; and an outer surface having diametrically opposed first and second indents adapted to operably receive prong end portions of a swing cap assembly; and further comprising an upper edge surface connecting said inner surface and said outer surface, said upper edge surface comprising a rounded nose portion and a ledge portion integrally connected to said rounded nose portion, wherein said upper edge surface is adapted to receive a curl portion of an aluminum bottle.

2. The outsert of claim 1, wherein said generally truncated cone-shaped inner surface comprises an upper edge diameter and a lower edge diameter, wherein said upper edge diameter is smaller than said lower edge diameter.

3. The outsert of claim 1, wherein said inner wall surface is unpenetrated by said indents.

4. A beverage bottle assembly comprising:

an aluminum bottle having a neck with an outsert mounting region including:

a constant diameter neck portion;

a rolled larger diameter neck portion integrally formed with the constant diameter neck portion at an upper end of the constant diameter neck portion; and an outwardly flared neck portion positioned below the constant diameter neck portion; and a bottle outsert mounted below the rolled larger diameter neck portion and engaging at least the rolled larger diameter neck portion and the outwardly flared neck portion, the outsert having an outer surface with diametrically opposed first and second indents therein adapted to pivotally receive prong end portions of a swing cap assembly.

5. The beverage bottle assembly of claim 4 further comprising an upper edge surface connecting said inner surface and said outer surface, said upper edge surface comprising a rounded nose portion and a ledge portion integrally connected to said rounded nose portion.

6. The beverage bottle assembly of claim 4, wherein said upper edge surface is adapted to seamlessly receive a curl portion of the aluminum bottle.

7. The beverage bottle assembly of claim 4, wherein said inner wall surface is unpenetrated by said indents.

8. The beverage bottle assembly of claim 4, further comprising: a swing cap assembly having:

a pivot assembly with opposed prong members received in said first and second indents;

a closure member mounted on said pivot assembly and adapted to sealingly cover and to uncover said bottle opening.

9. The beverage bottle assembly of claim 8 further comprising an upper edge surface connecting said inner surface and said outer surface, said upper edge surface comprising a rounded nose portion and a ledge portion integrally connected to said rounded nose portion.

10. The beverage bottle assembly of claim 8, wherein said upper edge surface is adapted to seamlessly receive a curl portion of the aluminum bottle.

11. The beverage bottle assembly of claim 8, wherein said inner wall surface is unpenetrated by said indents.

12. An outsert for an aluminum bottle comprising:

a generally truncated cone-shaped inner surface that is configured to be received and supported by an upper neck portion of the aluminum bottle, wherein said upper neck portion defines a liquid dispensing bottle top end opening; and an outer surface having diametrically opposed first and second indents adapted to operably receive prong end portions of a swing cap assembly that is adapted to selectively cover and uncover said liquid dispensing bottle top end opening.

13. The outsert of claim 12, wherein said generally truncated cone-shaped inner surface comprises an upper edge diameter and a lower edge diameter, wherein said upper edge diameter is smaller than said lower edge diameter.

14. The outsert of claim 1, wherein said inner wall surface is unpenetrated by said indents.

* * * * *